United States Patent [19]

Scheiwiller

[11] Patent Number: 4,884,378

[45] Date of Patent: Dec. 5, 1989

[54] STRUCTURAL ASSEMBLY FOR PRODUCING WALLS

[76] Inventor: Rolf Scheiwiller, Lindeneggweg 10,, CH-3645 Gwatt, Switzerland

[21] Appl. No.: 220,401

[22] Filed: Jul. 18, 1988

Related U.S. Application Data

[63] Continuation of Ser. No. 17,248, Feb. 20, 1987, abandoned.

[30] Foreign Application Priority Data

Feb. 21, 1986 [EP] European Pat. Off. ..... 86810092.6

[51] Int. Cl.[4] ..... E02D 5/20

[52] U.S. Cl. ..... 52/169.4; 405/284; 52/563; 52/604; 52/279

[58] Field of Search ..... 52/563, 569, 604, 588, 52/593, 605, 612, 169.4, 274, 275, 279, 281; 405/284, 286, 287

[56] References Cited

U.S. PATENT DOCUMENTS

| | | | |
|---|---|---|---|
| 707,444 | 8/1902 | Moses | 52/274 |
| 743,391 | 11/1903 | Kidder | 52/569 |
| 1,461,851 | 7/1923 | Kagermeier | 52/279 |
| 2,118,936 | 5/1938 | Malinovszky | 52/563 |
| 2,145,187 | 1/1939 | Miller | 52/563 |
| 2,881,613 | 4/1959 | Taylor et al. | 52/604 |
| 3,562,988 | 2/1971 | Gregoire | 52/279 |
| 4,003,172 | 1/1977 | Pawl | 52/605 |
| 4,448,571 | 5/1984 | Eckels . | |

FOREIGN PATENT DOCUMENTS

| | | | |
|---|---|---|---|
| 0065199 | 11/1982 | European Pat. Off. . | |
| 2230055 | 1/1974 | Fed. Rep. of Germany . | |
| 2419419 | 11/1975 | Fed. Rep. of Germany . | |
| 2436832 | 2/1976 | Fed. Rep. of Germany . | |
| 8501508 | 6/1985 | Fed. Rep. of Germany . | |
| 687605 | 8/1930 | France | 405/287 |
| 2142579 | 2/1973 | France . | |
| 2376269 | 7/1978 | France . | |
| 2571400 | 4/1986 | France . | |

*Primary Examiner*—Carl D. Friedman
*Assistant Examiner*—Caroline D. Dennison
*Attorney, Agent, or Firm*—Marks Murase & White

[57] ABSTRACT

A structural assembly is used for producing walls. The assembly includes a plurality of structural elements, each element having at least one surface defining at least a portion of a dovetail joint. A first one of the elements is parallelepiped in shape and includes a first longitudinal side, the longitudinal side defining a half dovetail groove at each of its ends. The first element also includes a centrally disposed full dovetail groove and a full dovetail tongue separating the full groove from each half-groove. A second element of the assembly corresponds to one half of the first element. A securing element is also provided which includes at least one side defining a dovetail tongue member corresponding to the full groove in the first element. The securing element also includes an aperture extending therethrough. The structural assembly can be manufactured very economically on conventional machines and permits garden walls and the like to be easily produced and also to be secured firmly in position.

26 Claims, 3 Drawing Sheets

STRUCTURAL ASSEMBLY FOR PRODUCING WALLS

This application is a continuation of application Ser. No. 017,248, filed on Feb. 20, 1987, now abandoned.

FIELD OF THE INVENTION

The present invention relates to a structural assembly for suitably producing walls. More particularly, the invention relates to an assembly which includes elements which jointly or separately define dovetail connection members.

BACKGROUND OF THE INVENTION AND RELATED ART DISCUSSION

Garden walls are produced, for example, from natural stone or from panels resembling natural stone, from planks or sleepers such as those used in the construction of railroads or from concrete slabs which, however, need to be reinforced if they exceed a certain length and which, in consequence, have relatively high manufacturing and production costs. While laying straight wall portions comprised of natural stone and similar materials is relatively simple, of securing of such elements to one another is generally complicated. The configurations of the corners of these types of walls are often aesthetically unpleasing, and their configuration also complicates the task of securing the elements.

Generally, the procedure of securing components of the above-described walls is such that encasement boards are provided behind the wall, so as to face the soil, and the rear surface of the walls is reinforced with concrete. If wooden sleepers are employed, securement may also be achieved by laying such sleepers transversely, but this arrangement complicates the construction of the wall. Moreover, railway sleepers are generally old and do not usually have a particularly attractive appearance. A further complication in the securing of stone or concrete walls arises, because the walls generally have to be partially encased during construction and have to be secured by means of concrete.

Structural elements having dovetailed joints are known, per se, from French publication FR-A-2 376 269, for example. This document describes structural elements which have circumferential grooves and which can be interconnected, through the intermediary of a connecting element having a tongue member at each end. Such structural elements can be used for the composite erection of smooth walls. However, these elements are not suitable for the erection of garden walls which need to be secured.

OBJECT OF THE INVENTION

The present invention seeks to provide a structural assembly for the erection of walls, particularly garden walls, which is easy and economic to produce, permits a simple method of erection to be employed, has a simple means of securement, and has a pleasing appearance.

BRIEF SUMMARY OF THE INVENTION

According to the present invention, there is provided a structural assembly capable of being used for producing walls, comprising a plurality of structural elements, each element including at least one surface defining at least a portion of a dovetail joint. A first one of the elements is a parallelepiped and includes a first longitudinal side, defining a half dovetail groove at each of its ends. A full dovetail groove is disposed at the center of the element, and, a full dovetail tongue or primary protrusion separates the full groove from each half-groove. A second of the elements corresponds one half of the first element and securing element means is also provided, securing element including at least one side, the defining a dovetail tongue member or primary protrusion corresponding to the full groove in the first element. The securing element also includes an aperture.

BRIEF DESCRIPTION OF THE DRAWINGS

The present invention will be further described, by way of example, with reference to the accompanying drawings, in which.

DESCRIPTION OF PREFERRED EMBODIMENTS

Figures 1, 2, 3, 4:
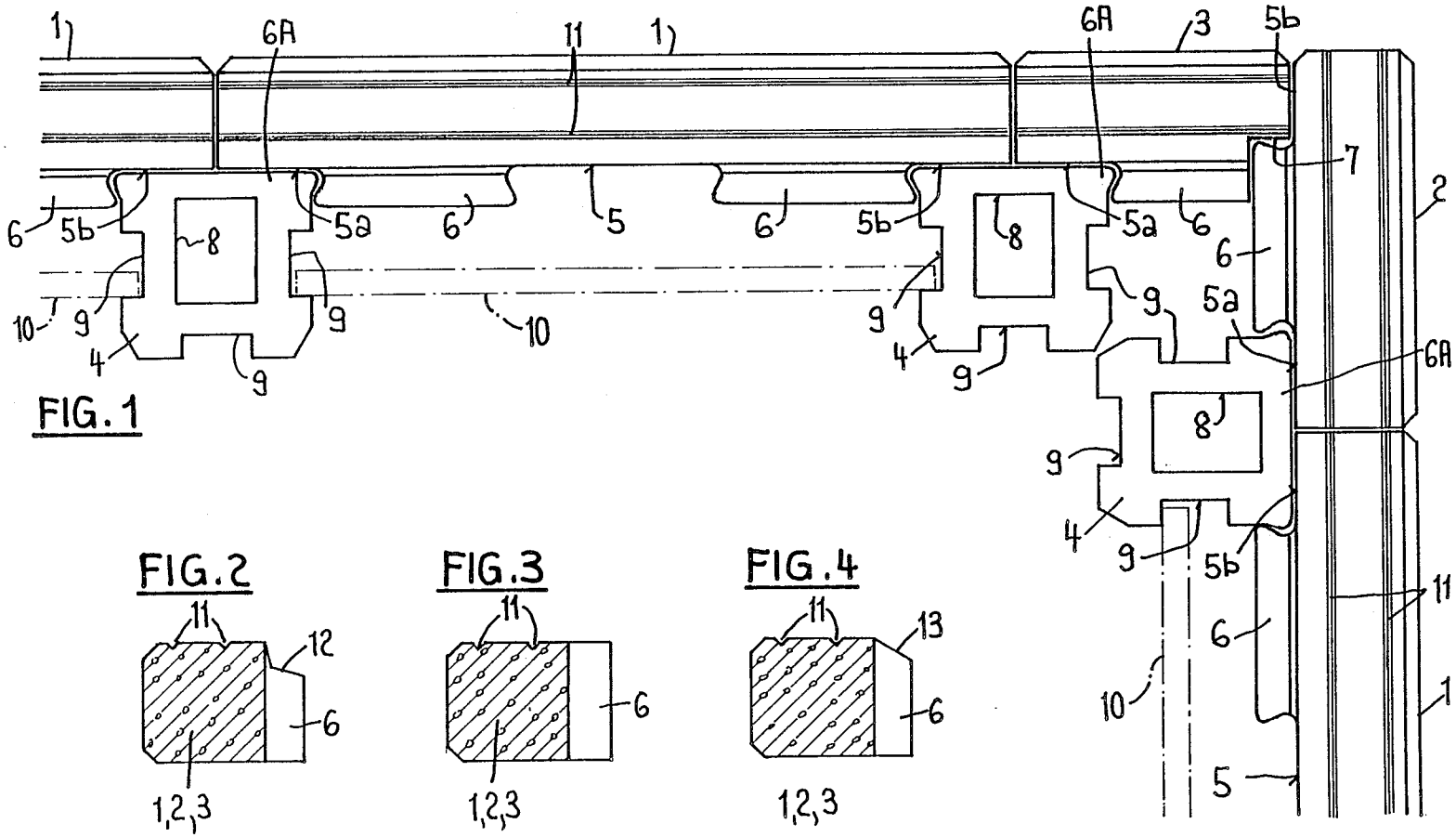
FIG. 1 is a plan view of a portion of a wall erected utilising the structural assembly of the present invention.
FIGS. 2, 3 and 4 are sectional views of three different modifications of elements of the structural assembly.

In FIG. 1, there are shown four different elements belonging to the structural assembly of the present invention. These comprise a first element 1, a second element 2, a third element 3 and a securing element 4. The element 1 has a substantially parallelepiped form and is provided with a dovetailed groove 5 in the centre of one of its longitudinal sides. A dovetail tongue member or primary protrusion 6 is disposed on each side of the groove 5, and half a dovetailed groove **5*a* and 5*b* respectively is disposed at each end of the element. The plane coincident with the recessed portion of the grooves 5, 5*a*, and 5*b* are referred to as connecting faces of the first element 1. These dovetail joint components are uniformly distributed along the length of the assembly. The second element 2 is exactly half the size of the element 1 and, in consequence, has two dovetail groove halves 5*a* and 5*b* between which is defined the dovetail tongue member 6. Again, the plane coincident with the most recessed portion of grooves 5*a* and 5*b* are the connecting faces of the second element 2**.

The length of the third element 3 corresponds to half that of the first less the width of second element 2— in the present embodiment, corresponding approximately to one-third of the length of the first element 1. In consequence, the third element 3 has one half of a dovetailed groove **5*a* at one of its ends. The plane coincident with recessed portion of groove 5*a* is the connecting face of third element 3. The other end of the third element 3 has a stepped or shoulder portion 7 whose length corresponds to the depth of the groove 5 of the first element 1. As seen in FIG. 1, the length 7 is the dimension running parallel to the connecting face of the third element 3. The depth of shoulder 7 is slightly greater than its length, as is shown in FIG. 1**.

The securing element 4 has a substantially square cross-section and is provided with an aperture 8 which extends therethrough. The aperture 8 is, in the present case, rectangular but it may also be round or of any other desired configuration. On one of its sides, the securing element 4 is provided with a tongue member **6*a* which fits into the groove 5 or into the two half-grooves 5a and 5b provided on adjacent elements. In the center of each of the other three outer surfaces of the securing element 4, there is provided an elongated groove 9 which extends over the entire height of the element and may accommodate plates or panels 10** which may either be encasement boards, if concrete is to be layed behind at least a portion of the wall, or which may serve to establish or form a gravel bed.

On their upper surfaces, each of the three elements 1, 2 and 3 is provided with two longitudinally extending cementing joints 11 which may have a permanently resilient cementing substance inserted therein for the purpose of achieving easier laying and better retention. There do not, of course, need to be two cementing joints and the cementing joints do not necessarily need to extend therethrough. Any type of recess may be provided.

FIGS. 2, 3 and 4 illustrate three possible different profiles for the elements 1, 2 or 3. In FIG. 2, which shows the preferred embodiment, the dovetail tongue member 6 includes a shoulder or stepped portion 12 on its upper surface, so that it is not visible after soil has been filledin, with the result that the wall appears to be continuous and straight when viewed from above. This can be seen in FIGS. 5 and 6. The element shown in FIG. 3 does not have such a stepped portion, while the dovetail tongue member 6 shown in FIG. 4 includes an inclined portion 13 on its upper surface rather than a stepped portion. If a wall is produced utilizing elements shown in FIG. 3, and a straight upper edge is desired, a coping stone 14, of the type shown in FIG. 7 may be used. The stone 14 may have one or two shoulder portions 15 formed on its lower surface to prevent sliding. To improve the appearance of the elements, the longitudinal and vertical edges of the elements 1, 2 and 3 may be chamfered.

The four elements 1, 2, 3, and 4 will generally be produced from concrete, although not necessarily reinforced concrete. However, in order to permit as economic a production as possible by conventional means while producing elements which can be easily carried by one or, at most, two workers, and in order to permit a high degree of flexibility in use, it is desirable if the element 1 has a length of one meter, a width of 15 cm plus an additional 5 cm for the dovetail tongue members, and a height of 15 cm. Accordingly, the elements 2 and 3 will have lengths of 50 cm and 35 cm respectively. The dimensions of the securing element 4, except for the side provided with the dovetail tongue member 6a, are of lesser significance that those of elements 1, 2 and 3. The securing element 4 may, for example, have a surface area of 25 cm×25 cm and a height of 15 cm although the height may also be 30 cm. Such dimensions permit economic production with maximum utilization of space, whereby unit elements may be produced with parting lines or separation joints. Alternatively, elements which are separate from the outset may be cast or moulded. In addition to normal concrete, lightweight concrete may also be used to fabricate the various elements. In particular, lightweight concrete sold under the commercial name of "Lecca", may be used. Other known materials which may, of course, have different colourations as well as treated or untreated surfaces may also be used.

Figure 6:
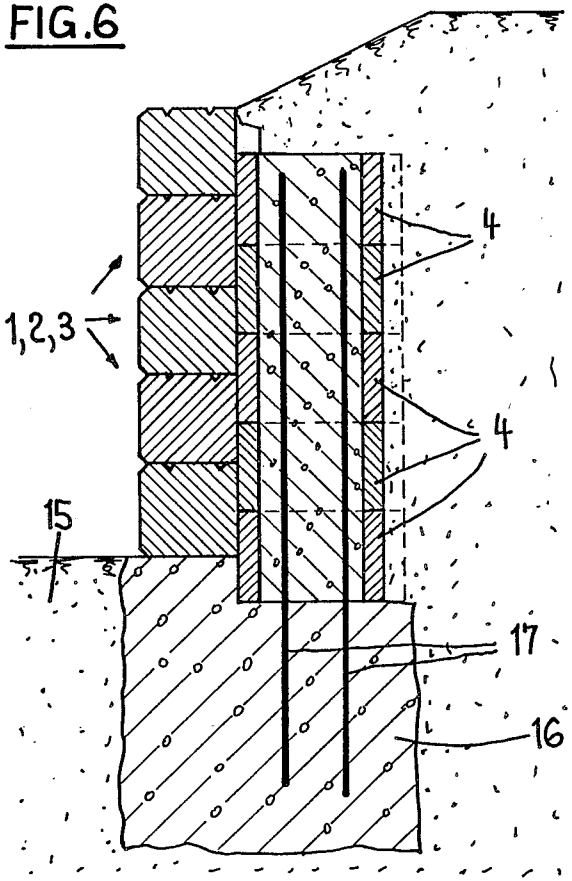
FIGS. 5 and 6 are sectional views of two different walls of the type shown in FIG. 1.
Figure 5:
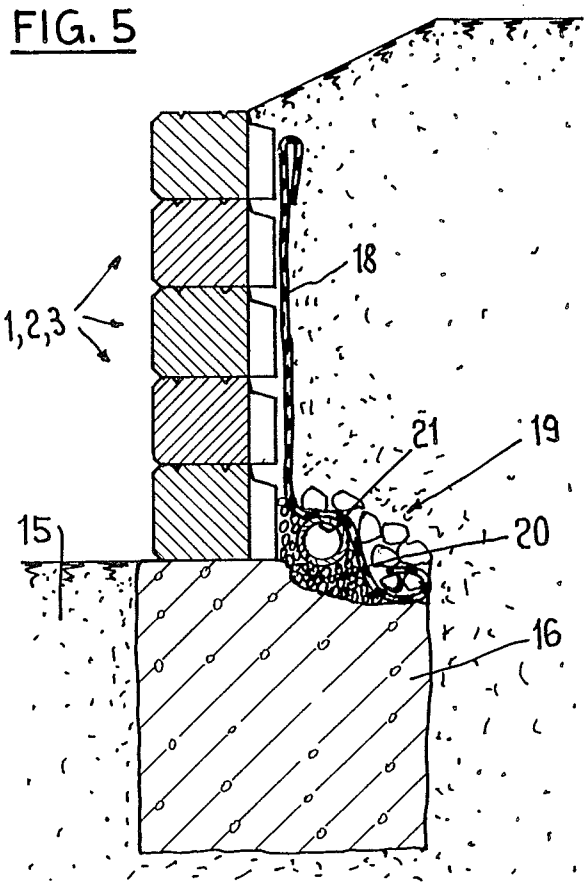

The erection of a back-filled garden wall will be explained hereinafter with particular reference to FIGS. 1, 5 and 6. FIG. 5 shows the wall portion between two securements, while FIG. 6 shows the securement with the securing elements 4. FIG. 5 shows a concrete foundation or base 16 which is erected in the soil and on which a few layers of the elements 1, 2, and 3 are built. In such a case, the elements are sandwiched together by means of a permanently resilient cementing substance which fixedly retains the elements 1, 2, and 3 in their correct position. In FIG. 6, the securing elements 4 are mounted at intervals of 50 cm or one meter simultaneously with the construction of the layers of slabs. Vertical reinforcements 17 are inserted into the openings in securing elements 4. As is particularly apparent from FIG. 6, it is advantageous to offset the securing elements by a distance corresponding to half the height of the slab elements, so as to achieve a better composite arrangement thereby.

After the entire wall has been erected, after the securing elements 4 have been fitted and the vertical reinforcements have been inserted, the whole wall can be checked once more and aligned, prior to the apertures 8 in the securing elements 4 being filled with concrete. A good drainage facility is very important for such walls which are to be back-filled with soil. The present elements are ideally suited therefor, because the rear surface of the elements is not smooth as a result of their being provided with grooves and tongue members. Consequently, the elements allow space for adequate water drainage. It is advantageous for the rear surface of the elements to be coated with a geotextile webbing or non-woven fabric 18 or the like, and for the lower surface of the elements to be provided with drainage material 19 and/or a gravel bed 20, as well as a conventional drainage pipe 21, so that the wall can be subsequently back-filled with soil.

Figure 7:
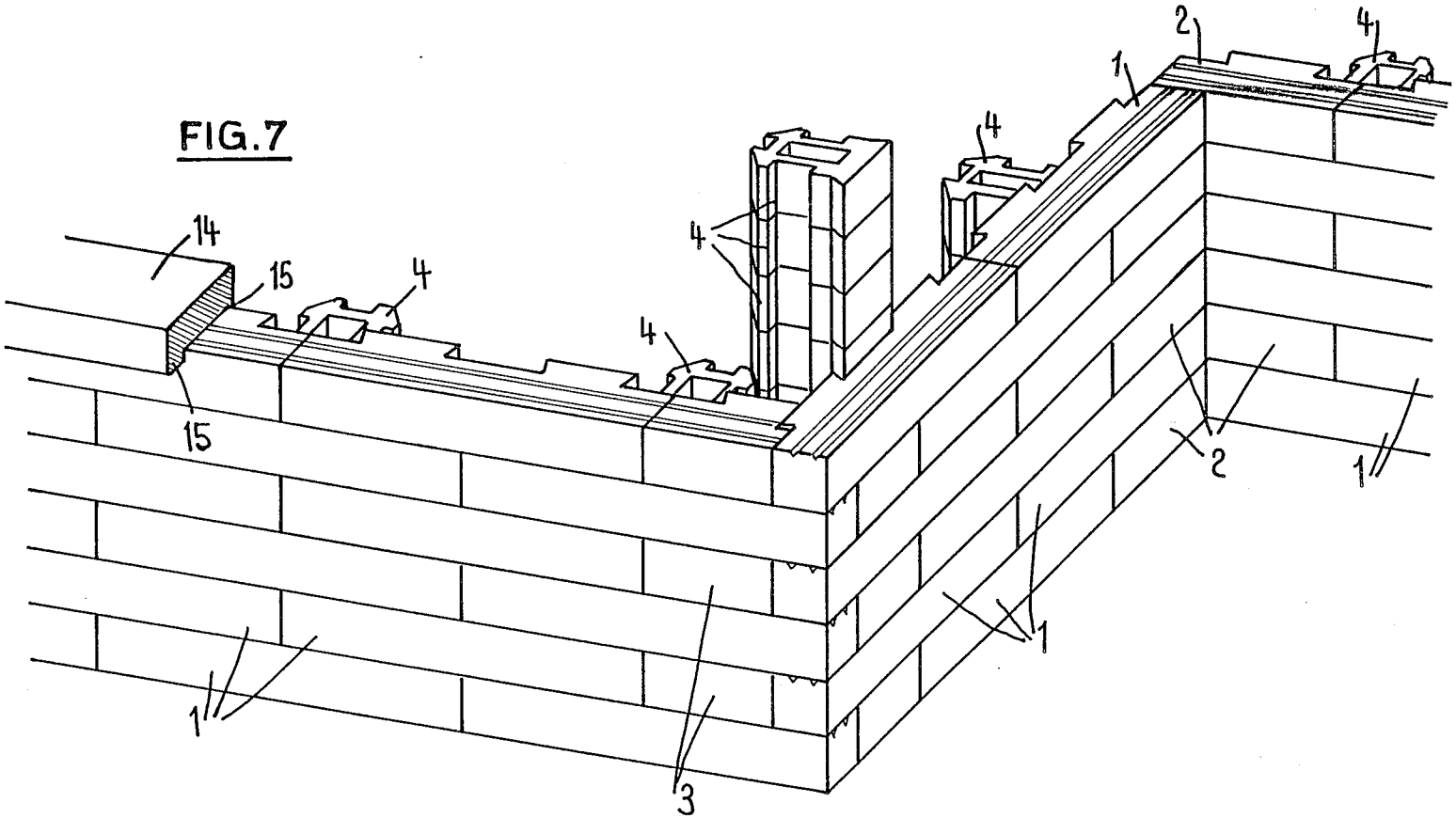
FIG. 7 is a side elevational view of a further wall arrangement erected using the structural assembly of the present invention.

Although assembly comprises only two major elements 1 and 2, a corner element 3, a securing element 4, the number of different applications thereof is very large. Thus, the securing element 4 can also be utilized as a visible feature of the wall. Thus, it can be seen in FIG. 7, for example, that corners may be formed in both directions and in both cases, a neatly-edges corner is produced. As a result of the selected dimension for the framework, especially in the case of the corner elements 3 having a width of approximately 35 cm plus 15 cm, the entire wall can be conveniently secured by the securing elements 4. In FIG. 7, it is further shown that the securing elements 4, if built one above the other, can form a column which may, for example, be used for the securement of a flagpole or for illumination purposes. It is, of course, also possible for the securing elements 4 to be built upwardly along the whole wall or along a portion thereof, and panels or the like may be placed therebetween to form a fence along which, for example, plants or shrubs may be trained. As has already been mentioned, the edge may be formed by means of edge panels and end plates 14.

As is shown in FIG. 1, the securing element 4 may also be used as a corner element or configuration element whereby, for example, the element 1, which is shown in its entirety, is displaced rearwardly and lies behind the thickened portion of the dovetailed tongue member 6a while the slab element, which continues to extend to the left, may form an angle, for example, in such a manner that its lower edge engages in the lower corner of the left-hand longitudinal groove 9 in the securing element 4 or is aligned with the first slab element. This arrangement also produces a co-operation between the slab elements and the securing element. It is self-evident that, by so doing, a better securing can be provided in those cases where mounting is particularly associated with a risk of slippage. The slippage risk is reduced because, for example, two securing elements 4 are used which are disposed one behind the other and which, in addition, are horizontally interconnected by reinforcement rods.

As is further apparent from FIG. 1, the slab elements may also be interconnected in such a manner that the dovetail tongue members 6 and dovetail grooves 5 engage in one another, thereby forming a double row with a side intended to be seen facing outwardly on both sides.

I claim:

1. A structural assembly comprising:

a plurality of primary elements each comprising a parallelepiped shaped primary body section having an anchoring face, at least one primary protrusion on said anchoring face for anchoring said primary element to a steep incline, said at least one primary protrusion being disposed in a primary connecting face of said primary body section, and primary connecting areas disposed on said primary connecting face adjacent to said at least one primary protrusion;

a plurality of cornering elements for establishing an angled connection with said primary elements, each such element comprising a parallelelepiped shaped cornering body section having a cornering connecting face, a cornering protrusion disposed on said cornering connecting face, and first and second cornering connecting areas disposed on said cornering connecting face on adjacent sides of said cornering protrusion;

wherein said primary connecting areas are adapted to be aligned adjacent to one another and adjacent to said second cornering connecting area, thereby forming grooves between pairs of adjacent cornering and primary protrusions; and a plurality of tubular securing means for engaging said grooves and firmly securing said anchoring faces to a steep incline.

2. The structural assembly according to claim 1, wherein said tubular securing means comprise substantially cube shaped members each having a securing face with a securing protrusion formed thereon for engaging said grooves.

3. The structural assembly according to claim 2, wherein said cube shaped member has an aperture extending substantially parallel to said securing face.

4. The structural assembly according to claim 3, wherein said cube shaped member further comprises retaining means for retaining panel members.

5. The structural assembly according to claim 4, wherein said retaining means comprise notches disposed on cube member faces.

6. The structural assembly according to claim 1, further comprising a double unit element, wherein said double unit element is an integrally formed embodiment of a pair of adjacent primary elements.

7. The structural assembly according to claim 6, wherein said security means comprises a substantially cube shaped member with a hollow interior having a securing face with a securing protrusion formed thereon for engaging said grooves.

8. The structural assembly according to claim 1, wherein said first cornering connecting area is a stepped shoulder portion and said second cornering connecting area is identical to said primary connecting areas.

9. The structural assembly according to claim 1, further comprising a coping means for covering an upper face of said primary element and said cornering element.

10. The structural assembly according to claim 9, wherein said coping means is a parallelepiped having a U-shaped recess on one face thereof.

11. The structural assembly according to claim 1, wherein said primary protrusions are dove tail tongue members and said grooves are dove tail grooves.

12. The structural assembly according to claim 11, further comprising a double unit element, said double unit element comprising:

a double unit parallelepiped body section;

a pair of double unit dove tail tongue members disposed on an anchoring face of said double unit body section;

a double unit dove tail groove disposed between said double unit dove tail tongue members;

a pair of double unit half dove tail grooves disposed along respective terminal portions of said double unit anchoring face, and a cube shaped securing means with a securing face adapted to engaged said dove tail shaped grooves.

13. The structural assembly according to claim 12, wherein said primary elements, cornering elements, and double unit elements each have chamfered edges.

14. The structural assembly according to claim 11, wherein said dove tail tongue members have an inclined portion at a first end thereof.

15. The structural assembly according to claim 14, wherein said primary elements, cornering elements, and double unit elements each have a recess formed in their respective upper surfaces.

16. The structural assembly according to claim 15, wherein said securing means comprise a substantially cube shaped member with retaining means for retaining panel members; and wherein said retaining means comprise notches disposed on cube member faces adjacent to said securing face.

17. The structural assembly according to claim 1, wherein said primary protrusion extends from said primary connecting face by a first distance; and wherein said first cornering connecting area extends along a length of said cornering body section by said first distance.

18. A pair of adjacent walls comprising:

a plurality of parallelepiped connecting elements each having an anchoring face comprising at least one connecting protrusion for anchoring said connecting element to a steep incline extending by a first distance from said anchoring face and a pair of terminal connecting areas disposed at terminal portions of said anchoring face;

a plurality of parallelepiped cornering elements for establishing an angled connection with said connecting elements each cornering element comprising a cornering protrusion extending from a cornering face thereof, and having first and second terminal cornering areas disposed at terminal portions of said cornering face;

wherein said first terminal cornering area is identical to said terminal connecting areas and said second terminal cornering area is a stepped shoulder portion extending along the length of said parallelepiped cornering element by said first distance and said connecting protrusions extend into said stepped shoulder portion by said first distance; and wherein said terminal connecting areas are adapted to be aligned adjacent to another and adjacent to said first cornering areas, thereby forming grooves between pairs of adjacent cornering and connecting protrusions; and a plurality of tubular securing means engaged in said grooves for firmly securing said anchoring face to a steep incline.

19. The adjacent walls according to claim 18, wherein said connecting elements have a plurality of first and second connecting protrusions disposed between said terminal connecting areas, said first connecting protrusions having grooves interposed between them, and said second connecting elements having only a single connecting protrusion.

20. The adjacent walls according to claim 18, wherein said connecting elements have a plurality of connecting protrusions disposed between said terminal connecting areas, said connecting protrusions having grooves interposed therebetween.

21. The adjacent walls according to claim 18, wherein said connecting elements have only a single connecting protrusion.

22. The adjacent walls according to claim 18, wherein said plurality of connecting elements are arranged adjacent one another in horizontal rows.

23. The adjacent walls according to claim 22, further comprising a plurality of said rows superposed atop one another.

24. The adjacent walls according to claim 18, wherein said tubular securing means each comprise a substantially cube shaped member having a securing face with a securing protrusion means formed thereon for engaging said grooves.

25. The structural assembly according to claim 24, wherein said cube shaped member has an aperture extending substantially parallel to said securing face.

26. The structural assembly according to claim 25, wherein said cube shaped member further comprises retaining means for retaining panel members.

* * * * *